US005134820A

United States Patent [19]

Liu

[11] Patent Number: 5,134,820

[45] Date of Patent: Aug. 4, 1992

[54] ADJUSTABLE BUILT-UP STAIR

[76] Inventor: Ing-Nan Liu, No. 38, Muh Jah Rd., Sec. 1, Taipei, Taiwan

[21] Appl. No.: 584,763

[22] Filed: Sep. 19, 1990

[51] Int. Cl.[5] ..... E04F 11/02

[52] U.S. Cl. ..... 52/183; 182/228

[58] Field of Search ..... 52/182, 183, 187; 403/320; 411/433; 182/228

[56] References Cited

U.S. PATENT DOCUMENTS

| | | | |
|---|---|---|---|
| 3,089,481 | 5/1963 | Hinden | 403/320 |
| 3,474,882 | 10/1969 | Ernst | 52/182 |
| 4,557,085 | 12/1985 | Yamazaki | 52/182 |
| 4,812,094 | 3/1989 | Grube | 411/533 |

FOREIGN PATENT DOCUMENTS

| | | | |
|---|---|---|---|
| 2834058 | 2/1980 | Fed. Rep. of Germany | 52/182 |
| 27526 | 12/1909 | Sweden | 52/187 |
| 600092 | 6/1978 | Switzerland | 52/183 |

*Primary Examiner*—James L. Ridgill, Jr.
*Attorney, Agent, or Firm*—Bacon & Thomas

[57] ABSTRACT

A built-up stair assembly of includes a plurality of stair units, of which the angular position of each unit stair can be flexibly adjusted horizontally as well as vertically. Each stair unit includes a T-shaped plate mounted with a tread board and having a holder plate on the top and a socket on the bottom such that the holder plate of one stair unit can be inserted in the socket of another stair unit for connection in series. A handrail is laterally mounted on the top of the tread boards of the stair units when then are connected in series.

4 Claims, 3 Drawing Sheets

ADJUSTABLE BUILT-UP STAIR

BACKGROUND OF THE INVENTION

The present invention is related to stairs and more particularly to an adjustable built-up stair assembly for all buildings which can be flexibly adjusted on its height and angular position.

Regular indoor or outdoor stairs are generally of fixed type and not adjustable. For building a reinforced concrete stair, fornwork shall be set up before concrete pouring process. After setting of the concrete, the form-stripping and surface finishing process shall be followed. For the construction of a reinforced concrete stair, only experienced workers can do the job. For the construction of a wooden stair, the posts, landings, treads, risers, floor joists and strings shall be respectively made by skillful carpenters for further connection by means of fastening means or through mortise-and-tenon, housed or dovetailed joint. therefor, for the construction of wooden stairs, high productivity can not be expected and high cost can not be eliminated.

In generally, the conventional reinforced concrete and wooden stairs can not eliminate the following disadvantages;

1. Uniform configuration can not be achieved since a stair is shape-formed according to the space available;
2. Adjustable structure can not be expected since the conventional stairs are all of fixed type;
3. High productivity can not be achieved since the conventional stairs can not be pre-fabricated and the complicated construction process of which can not be simplified; and
4. Maintenance problem can not be eliminated since no standardized parts are used and only professional people can do the job.

SUMMARY OF THE INVENTION

One object of the present invention is to provide an adjustable built-up stair assembly which can be flexibly set up for positioning change horizontally as well as vertically according to the type of a building.

Another object of the present invention is to provide an adjustable built-up stair assembly which is easy to built up and detach without any special technique.

Still another object of the present invention is to provide an adjustable built-up stair assembly which utilizes standardized parts manufactured through mass production to reduce the cost.

A yet further object of the present invention is to provide an adjustable built-up stair assembly which is formed of a plurality of stair units, each of which is structrually reinforce by means of an unitary, rectangular reinforcing bottom block to stabilize its loading.

An adjustable built-up stair assembly in accordance with the present invention is generally comprised of a plurality of stair units releasably adjustably connected in series. Each stair unit comprises a substantially T-shaped plate having an unitary socket downwardly extending therefrom, a tread board mounted on the top, and a bolt sleeve structured holder plate at the back of the tread board. Therefore, one stair unit can be connected with another in series by means of inserting the bolt sleeve structured holder plate of a first stair unit into the socket of a second stair unit for further fastening by a bolt. Two toothed nuts and a ratchet washer are respectively mounted on the bolt sleeve of each holder plate to control the range of the rise between each two stair units. Through the connection of the socket of one stair unit with the bolt sleeve structured holder plate of another and the control of the toothed nuts and ratchet washer on each holder plate, the position of the ratchet washer on each holder another can be flexibly adjusted horizontally as well as vertically.

DETAILED DESCRIPTION OF THE PREFERRED EMBODIMENTS

Figure 2:
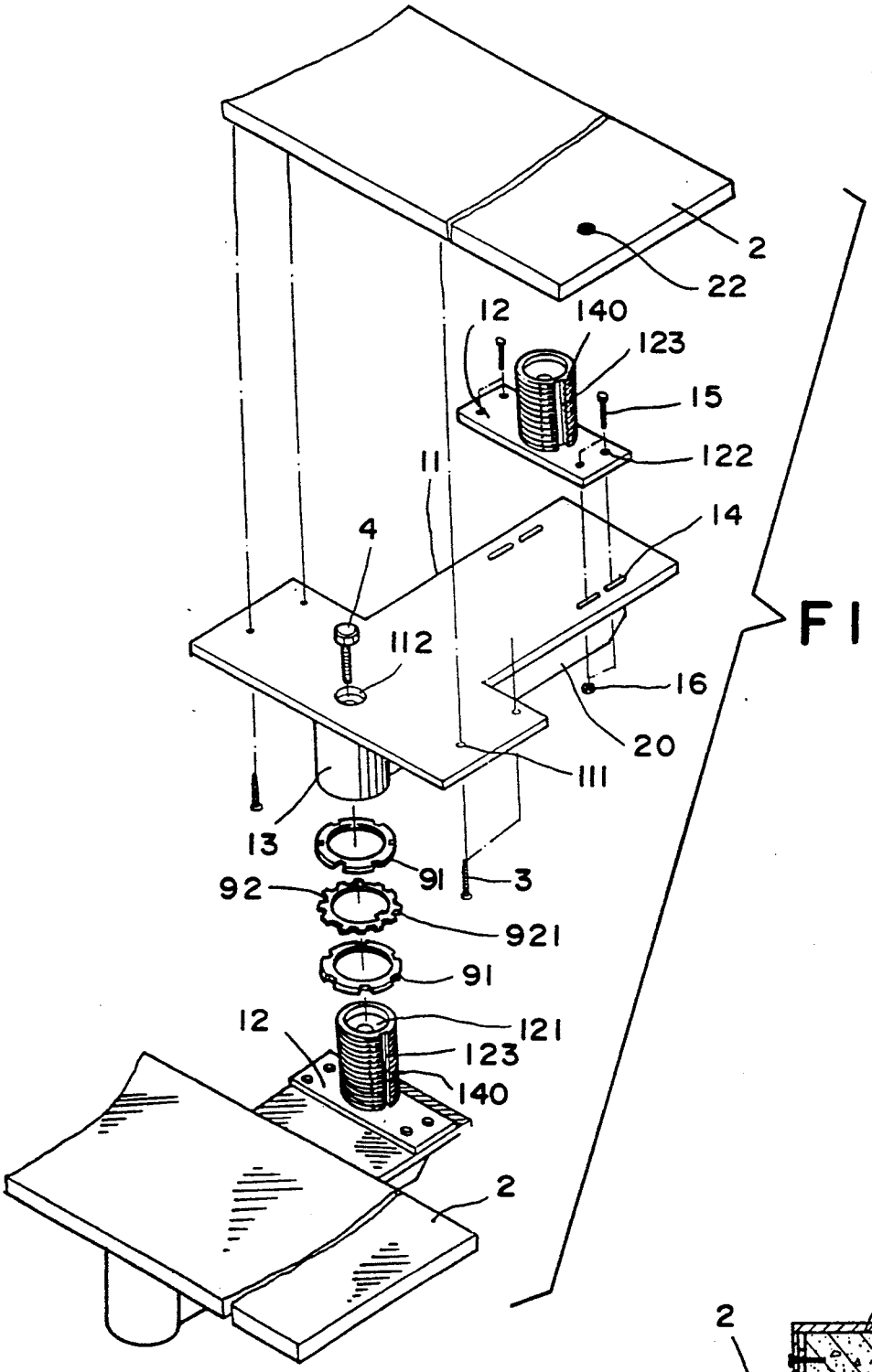
FIG. 2 is a partly perspective fragmentary view of the present invention, illustrating the structure of the stair units.

Turning now to the annexed drawings in greater detail and referring first to FIG. 2, an adjustable built-up type stair assembly in accordance with the present invention is generally comprised of a plurality of stair units. A stair unit in accordance with the present invention comprises a substantially T-shaped plate (11) having a cross arm portion and a base portion extending from the base portion to form a T-shape, and two pairs of elongated slots (14) on the base portion, an unitary socket (13) extending downward from the cross arm portion, a stepped hole (112) centrally on the cross arm portion and a plurality of bolt holes (111) bilaterally on the cross arm portion; a holder plate (12) comprising a bolt sleeve (140) having a vertical cutting (123) therethrough and a flat bottom surface portion having a plurality of trough-holes (122) corresponding to the two pairs of elongated slots (14) of the T-shaped plate (11) for the insertion therein of a bolt (15) each to screw up with a nut (16) so as to secure the holder plate (12) and the T-shaped plate (11) together; and a tread board (2) having bolt holes thereon corresponding to the bolt holes (111) of the T-shaped plate (11) for the insertion therein of a screw (3) each to secure such a tread board (2) to the T-shaped plate (11). Two toothed nuts (91) are mounted on the bolt sleeve (140) of the holder plate (12). A ratchet washer (92) is also mounted on the bolt sleeve (140) of the holder plate (12) and set in between the two toothed nuts (91) permitting its inner projection (921) to set in the vertical cutting (123) of the holder plate (12) so that it can be guided to move vertically. According to the present invention, the T-shaped plate (11) includes a unitary, rectangular reinforcing bottom block portion (20) to reinforce its structure.

Figure 3:
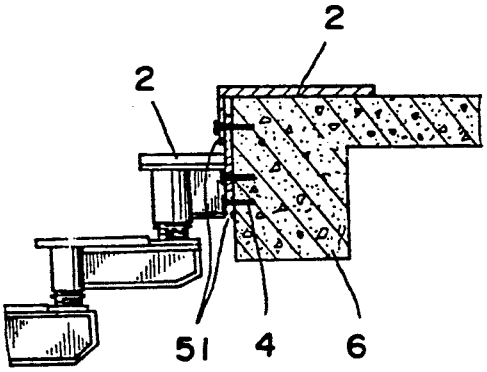
FIGS. 3 and 4 are sectional plan views, illustrating a plurality of stair units connected in series and secured to a floor of an upper level of a building.
Figure 4:
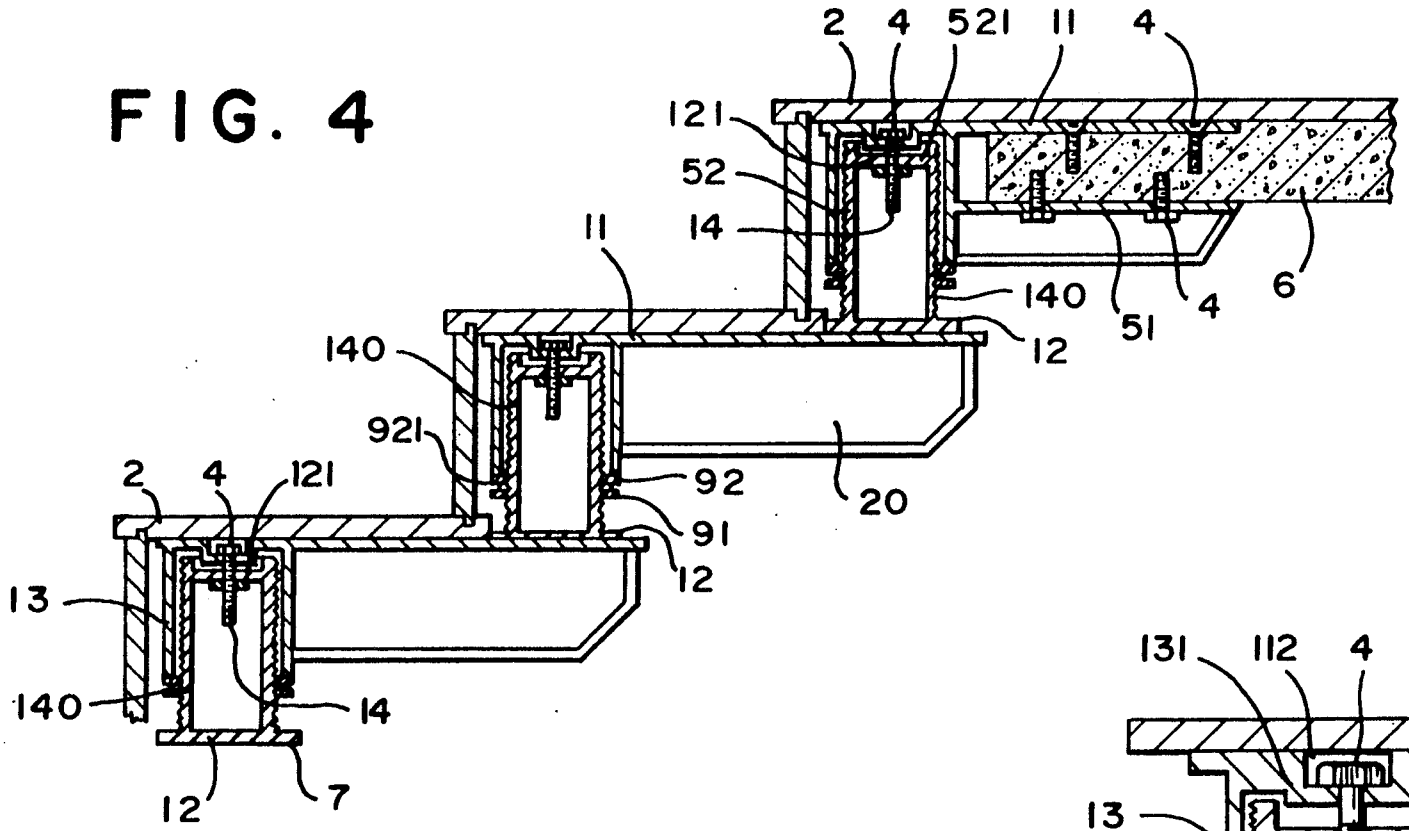
Figure 5:
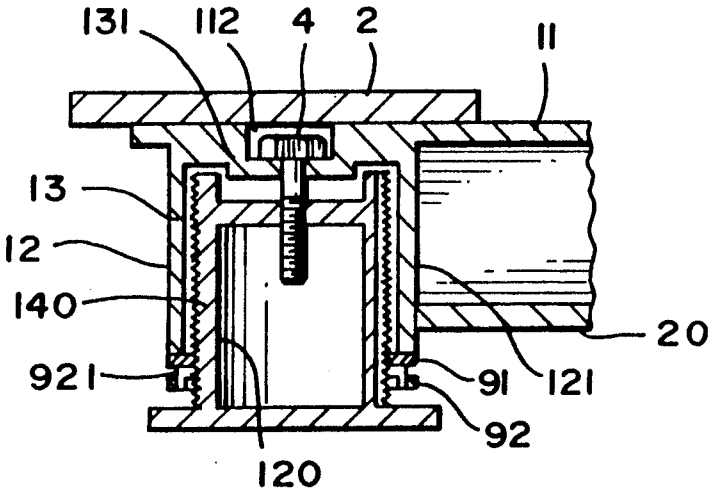
FIG. 5 is a partly sectional view of the present invention, illustrating the fastening of the bolt sleeve of the holder plate of one stair unit in the socket of another stair unit.

Referring to FIGS. 2 and 3, the bolt sleeve (140) of the holder plate (11) of one stair unit is inserted in the unitary socket (13) of another stair unit for connection. According to the present invention, the socket (13) and the bolt sleeve (140) of the holder plate (12) of each stair unit comprise each a division board (131) or (121) therein, which division board (131) or (121) comprises a bolt hole through its central axis. Therefore, when the bolt sleeve (140) of the holder plate (11) of a first stair unit is inserted in the unitary socket (13) of a second stair unit, a bolt (4) is inserted from the stepped hole (112) on the second stair unit into the bolt hole of the division board (131) of the socket (13) of the second stair unit and the bolt hole of the division board (111) of the holder plate (11) of the first stair unit to firmly secure the first and second stair units together. According to the present invention, the socket (13) of each stair unit can be internally threaded for connecting with the bolt sleeve (140) of the holder plate (12) of another stair unit by means of screw joint or has a smooth inner wall surface (120) just for the insertion therein of the bolt sleeve (140) of the holder plate (12) of another stair unit permitting two stair units to be secured by a bolt (4). Before building up a stair assembly, the rise between each two stair units is pre-adjusted according to he range between two levels of a building by adjusting the level position of the two toothed nuts (91) and the ratchet washer (92) on the bolt sleeve (140) of the holder plate (12) of each stair unit. Because of the arrangement of the elongated slots (14) on each T-shaped plate (11), a holder plate (12) can be adjustably mounted on each T-shaped plate (11) according to the angle of inclination of the stair string required. When a plurality of stair units are connected to form a stair assembly, an upper end stair unit which is comprised of a T-shaped plate (51) having an unitary socket (52) downwardly extending therefrom is connected thereto at the top for securing the stair assembly thus built up to the floor or landing (6) of an upper level of a building, and a lower end stair unit (7) which is comprised of T-shaped plate having a holder plate (12) fastening thereto is connected thereto at the bottom for securing the stair assembly thus built up to the floor of a lower level of a building. In actual practice to build up a stair assembly in a building, a lower end stair unit (7) is first secured by two bolts to the floor of a level of a building, then, a plurality of stair units are upwardly connected thereto in series, and finally, a upper end stair unit is connected between the floor of an upper level of such a building and the stair units which are connected in series. After assembly, the toothed nuts (91) and the ratchet washer (92) on the bolt sleeve of each holder plate (12) are properly adjusted to compensate any error in height.

Referring to FIGS. 1 and 2 again, because the connection of stair units according to the present invention is controlled by means of inserting the bolt sleeve (140) of a holder plate (12) in a socket (13) and the rise between each two stair units is controlled by means of adjusting each set of toothed nuts (91) and ratchet washer (92) on the bolt sleeve (140) of each holder plate (12), the angular position of a stair unit relative to another can be flexibly adjusted before a stair unit is fixedly secured to another. Therefore, the present invention is also very practical for building up a spiral stair, left-hand stair or right-hand stair assembly.

Figure 1:
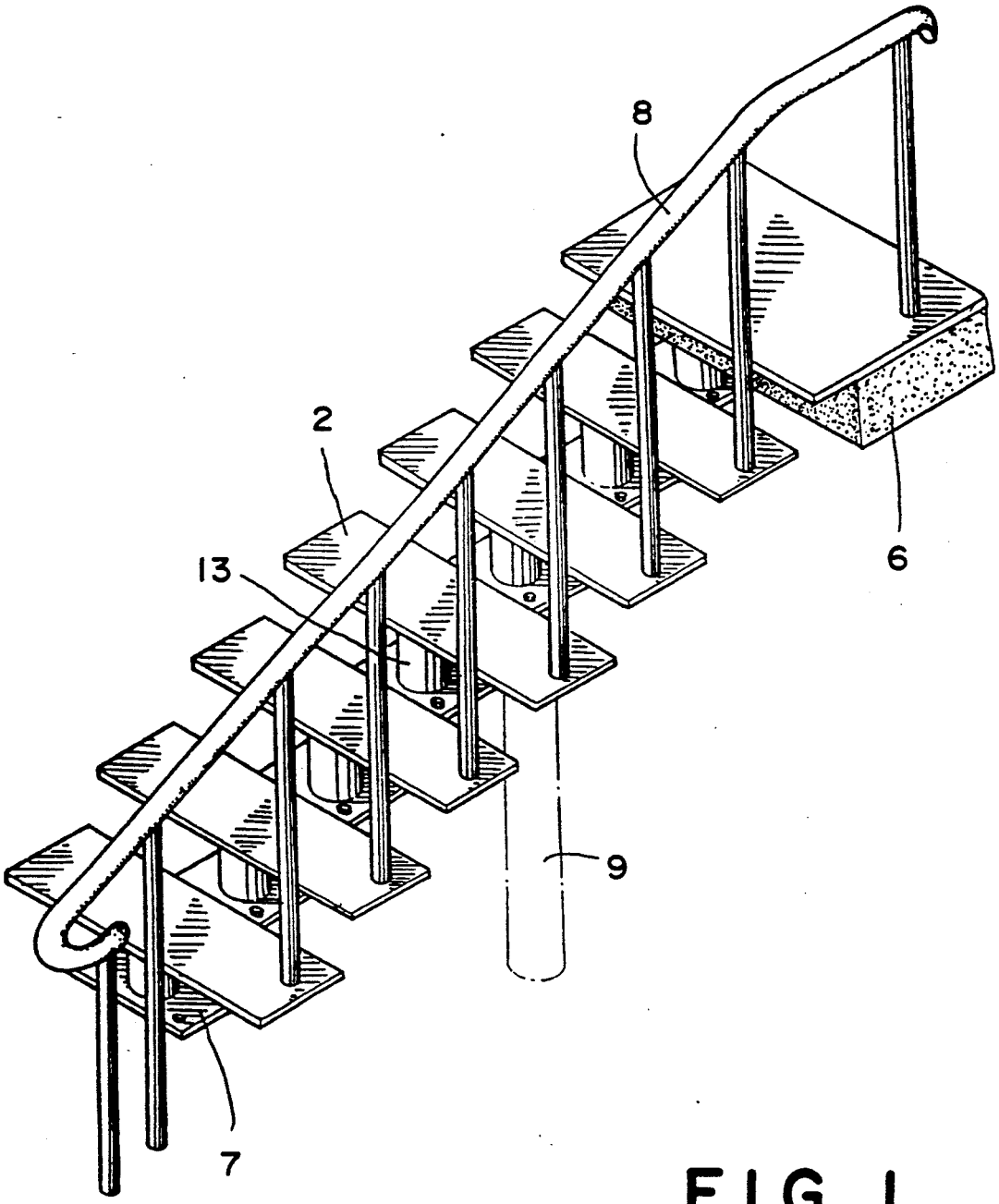
FIG. 1 is a perspective view of an adjustable built-up stair assembly in accordance with the present invention.

When an extended type of stair assembly is built up, a post (9) may be used to stop on the reinforcing bottom block portion (20) of either T-shaped plate (11) to support the whole structure (see FIG. 1).

As shown in FIG. 2, each tread board (2) comprises laterally a bolt hole (22) for the insertion therein of a bolt to secure the baluster (81) of a handrail (8) thereto.

As indicated, the present invention is to provide an adjustable built-up stair assembly which can be produced through mass production to reduce the cost, is easy to install and convenient for delivery and packaging with reduced space occupation. However, it is apparent that various modifications could be made to the present invention without departing from the basic teaching thereof.

I claim:

1. A stair assembly, including an upper end stair unit, a lower end stair unit and a plurality of intermediate stair units connected in series therebetween, wherein said intermediate stair units each comprise:

a substantially T-shaped plate having a cross arm portion and a base portion extending from the cross arm portion to form a T-shape, said T-shaped plate including two pairs of elongated slots in said base portion;

a holder plate connected to said T-shaped plate by means of nuts and bolts, said bolts extending through said elongated slots;

a unitary socket extending downwardly from said cross arm portion;

a unitary reinforcing bottom block portion extending downwardly from said base portion and horizontally from said unitary socket;

a stepped hole centrally located in said cross arm portion; and a plurality of tread board bolt holes located bilaterally on said base operation for the connected thereto of a tread board, wherein said holder plate comprises a bolt sleeve having a vertical cutting, and two toothed nuts and a ratchet washer mounted on the bolt sleeve, and said ratchet washer is retained between said two toothed nuts and comprises an inner projection set in said vertical cutting of said holder plate, and wherein said socket and said bolt sleeve of said holder plate comprise internally a division board each having a bolt hole therethrough for the insertion therethrough of a bolt from said stepped hole to secure two intermediate stair units together when the bolt sleeve of the holder plate of one intermediate stair unit is inserted in the unitary socket of another intermediate stair unit.

2. A stair assembly as claimed in claim 1, wherein said lower end stair unit comprises a T-shaped plate having a holder plate mounted thereon.

3. A stair assembly as claimed in claim 1, wherein said upper end stair unit comprises a T-shaped plate having a unitary socket extending downwardly therefrom.

4. A stair assembly as claimed in claim 1, wherein said socket has a smooth inner wall surface for the insertion therein of the bolt sleeve of a holder plate of another intermediate stair unit permitting two stairs to be secured by said bolt.

* * * * *